United States Patent [19]

Santi

[11] 4,282,823

[45] Aug. 11, 1981

[54] UNDERWATER HULL OR TANK

[75] Inventor: Giunio G. Santi, Milan, Italy

[73] Assignee: S.S.O.S. Sub Sea Oil Services S.p.A., Milan, Italy

[21] Appl. No.: 62,064

[22] Filed: Jul. 30, 1979

[30] Foreign Application Priority Data

Aug. 4, 1978 [IT] Italy ..... 26474 A/78

[51] Int. Cl.[3] ..... B63G 8/00; B65D 8/10; B65D 88/06

[52] U.S. Cl. ..... 114/341; 114/257; 220/3; 220/5 A; 220/71

[58] Field of Search ..... 114/257, 312, 341, 342; 220/3, 71, 5 A

[56] References Cited

U.S. PATENT DOCUMENTS

| | | | |
|---|---|---|---|
| 2,329,970 | 9/1943 | Zimmerman | 220/71 |
| 2,366,140 | 12/1944 | Alderfer | 220/3 |
| 2,844,271 | 7/1958 | Shelton | 220/3 |
| 2,962,195 | 11/1960 | Greenlee | 220/3 X |
| 3,329,297 | 7/1967 | Jordon | 220/3 |
| 3,413,947 | 12/1968 | Picard | 114/342 |
| 3,414,155 | 12/1968 | Corvino | 220/5 A |
| 3,598,275 | 8/1971 | Francois | 220/444 |
| 3,608,767 | 9/1971 | Elliott et al. | 220/3 X |
| 3,611,966 | 10/1971 | Hunter | 220/3 X |
| 3,677,432 | 7/1972 | Kaempen | 220/71 X |

*Primary Examiner*—Allan N. Shoap
*Attorney, Agent, or Firm*—Darbo & Vandenburgh

[57] ABSTRACT

A structure for an underwater hull or tank which is required to withstand a high external pressure due to use at great immersion depths. The hull or tank is composed of one or more toric components formed of metal, which may be filled with a pressure-resistant material for added strength. The toric components are interconnected by connecting rings welded between adjacent toric components, and longitudinal connecting beams which are welded to the toric components and connecting rings.

1 Claim, 12 Drawing Figures

UNDERWATER HULL OR TANK

BACKGROUND AND SUMMARY OF THE INVENTION

The invention relates to underwater hulls or tanks and more particularly to pressure-resistant underwater hulls or tanks suitable for use at great immersion depths.

Hulls and tanks subjected to external compression have typically been constructed of, for example, cylindrical structures with domed ends, spherical structures, and multiple-shaped spherical-cylindrical-elliptical structures connected together in a suitable manner to form a desired configuration.

The dimensioning of a structure which is subjected to external compression is governed by the pressure value, the nature of the material used (as a function of the modulus of elasticity and mechanical properties), and particularly by specific factors relating to the configuration of the structure (diameters, length-diameter ratios, distances between the reinforcing elements), and also by specific structural features such as welded joints, flanged joints, etc. It is particularly important to avoid local deformation of the structure due to elastic instability caused by the compressive stress originating from external pressure.

The dimensioning of an underwater hull or tank therefore requires a material distribution adapted to particular requirements, with corresponding influence upon the structural costs, both due to the weight of the structure (owing to great sheet metal thicknesses and size of reinforcing elements) and due to the technology employed (such as use of high grade special steel).

In prior art structures these requirements are of critical importance and at times are impossible to satisfy, since if a specific immersion depth and a specific displacement and/or storage capacity are exceeded, on one hand the additional weight of the structure can no longer be balanced by increased buoyancy due to the disproportionately great sheet metal thicknesses, and on the other hand the structure cannot be constructed due to the technological difficulties created by the great sheet metal thicknesses required.

The storage of liquids (water, fuels, combustion supports, hydraulic fluids, etc.) and gases (combustion supports, air, breathing gas mixtures, etc.) on board underwater hulls or tanks is presently accomplished by use of suitable tanks which are arranged partly within the hull and which therefore intrude within usable internal space. This often is disadvantageous in structures of limited internal volume, such as a submarine.

These and other disadvantages of the prior art are overcome by the present invention which comprises a structure for underwater hulls or tanks, which hulls or tanks are required to withstand a high external pressure, such as service at great immersion depths. The structure is composed of these basic elements, one or more toric components, a ring connecting adjacent toric components and one or more longitudinal connecting beams. Advantages of such construction include lightness in weight, increased strength, ability to withstand considerably greater immersion depths compared to the prior art, simple construction and versatile assembly, and reduction of the space required for the storage of liquids and gases inside or outside the hull due to the possibility of utilizing the interiors of the toric components as tanks.

A hull or tank consisting of toric components according to the invention is considerably stronger than a conventional structure of equal weight. Likewise, from a certain immersion depth downward, the invention allows a substantial reduction in weight of the structure as compared to conventional structures. These advantages of the invention are principally due to the following features:

The wall thickness of the toric components can be reduced due to the double curvature and the overall weight of the structure is reduced in spite of the larger surface area of the metal sheets required to produce the toric components and in spite of the weight of the connecting elements used to connect the toric components. The economy in weight which can be achieved as compared to conventional structures depends upon the dimensions, the configuration and the immersion depth.

Because the internal volumes of the toric components can serve as storage space for gases or liquids, the use by the prior art of particular tanks mounted within the hull is unnecessary, resulting in a corresponding reduction in weight.

The toric components can be pressurized with the aid of compressed substances introduced in a liquid state and which later solidify, allowing smaller wall thicknesses and hence achieving more favorable weight ratios. The structure is pretensioned when constructed in this manner, resulting in increased elastic stability when it is submerged and exposed to external pressure.

The toric components also present versatile assembly possibilities because standardized prefabricated components can be joined together by means of simple welded or flanged joints.

Furthermore, toric finished components are more economical to assemble, with simultaneous reduction of production time, due to the capability of such components to be readily joined together even if components are of varying shapes or sizes.

In many cases, the invention allows development of structures which would not be feasible with conventional structures, such as:

Hulls for submarines which are intended for operation at greater immersion depths than are hitherto attainable due to the buoyancy to weight ratio for cylindrical and spherical structures. Hulls constructed with toric components produce, for equal effective buoyancy, a lower weight of the structure and thus permit a greater working immersion depth. In order to attain even greater immersion depths, the toric components may additionally be internally compressively stressed, pretensioning the structure and increasing its load limit.

Hulls for submarines with engines which require the storage of propellants. In such cases, the toric components not only constitute the load bearing structure of the submarine, but also provide the storage chambers necessary to accommodate the propellants. In general the volumes available in the toric components are useful for various purposes, such as trim cells, on board gas and liquid supplies and storage of water ballast.

Tanks for the storage of petroleum products on the seabed. Because the tanks can be maintained at atmospheric pressure due to their strength, the problem of petroleum degassing is thus avoided.

The structure is composed of three basic elements:

1. A toric component.
2. A connecting ring which contributes transverse resistance and watertightness.
3. A longitudinal connecting beam.

Structures assembled with these three basic elements may also, depending upon the hull or tank to be produced, include further components, such as hemispherical caps applied to the ends of the structure and serving as closure elements, as will be more evident from the following detailed description of the invention.

DESCRIPTION OF THE DRAWINGS

The invention is illustrated in the accompanying drawings, in which.

DESCRIPTION OF SPECIFIC EMBODIMENT

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

All the basic elements of the invention are readily reproducible and can therefore be prepared independently by mass production before the assembly of the tank or hull is undertaken.

Figure 1:
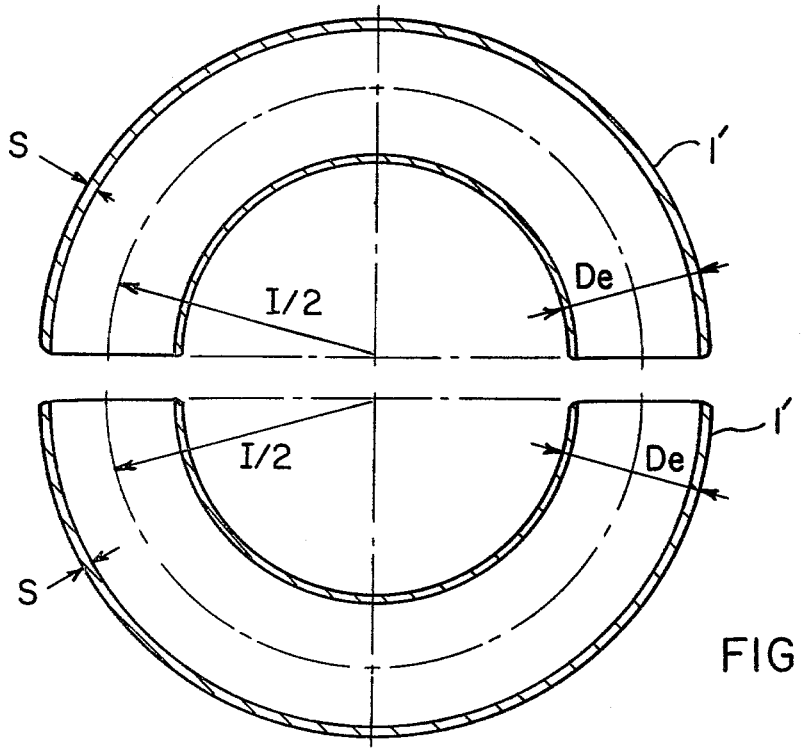
FIG. 1 shows in section two 180° pipe bends used to form a toric component, as illustrated in FIG. 1*a;*
Figure 2:
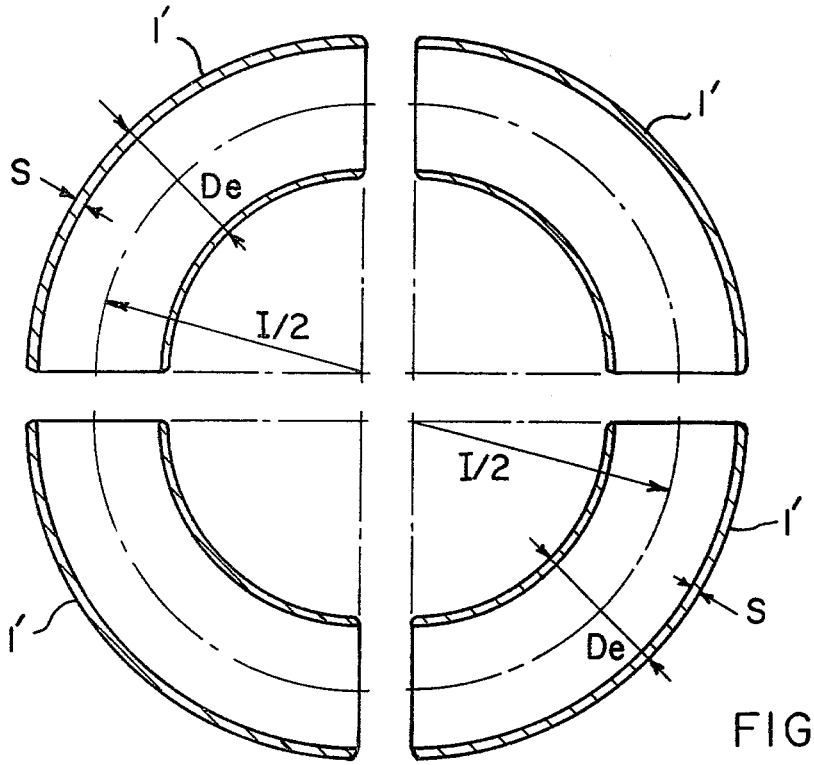
FIG. 2 shows in section four 90° pipe bends used to form a toric component, as illustrated in FIG. 2*a;*
Figure 1A:
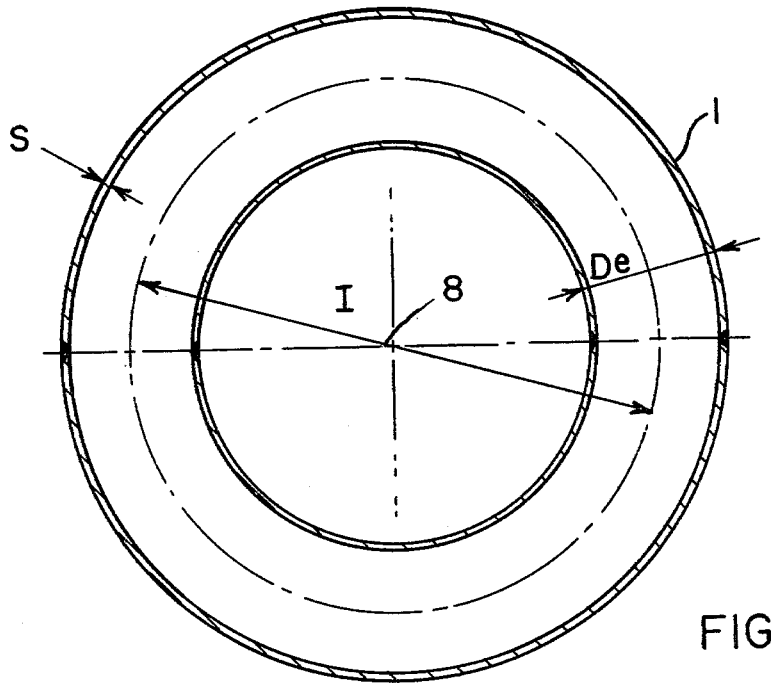
Figure 2A:
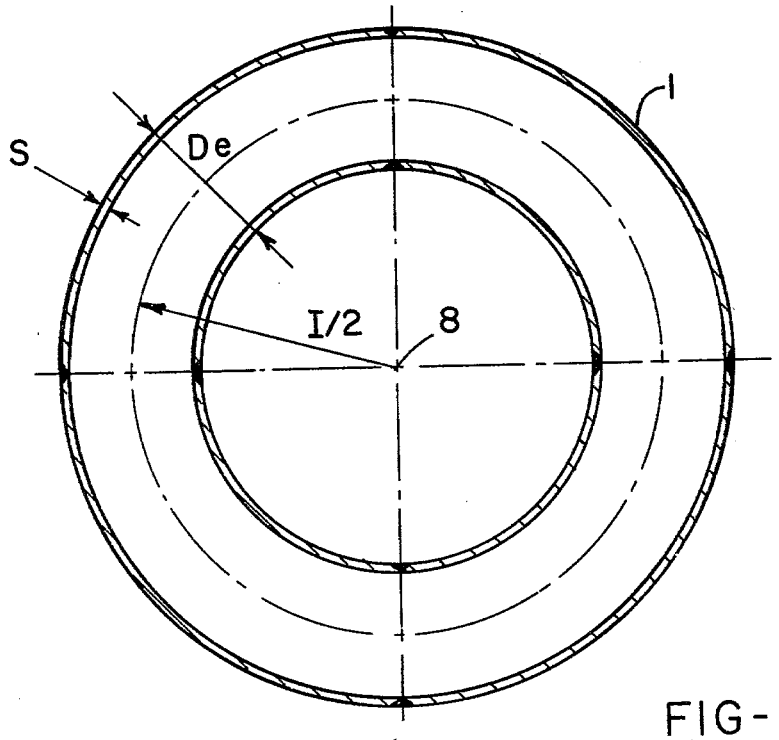

As shown in FIGS. 1, 1*a,* 2 and 2*a,* the toric component 1 has a cross-sectional diameter De, a wall thickness S and a distance between centers I which is chosen as a function of the desired capacity of the hull or tank. The toric component may generally consist of tube or pipe bends 1' welded together about an axis 8, as shown.

Figure 3:
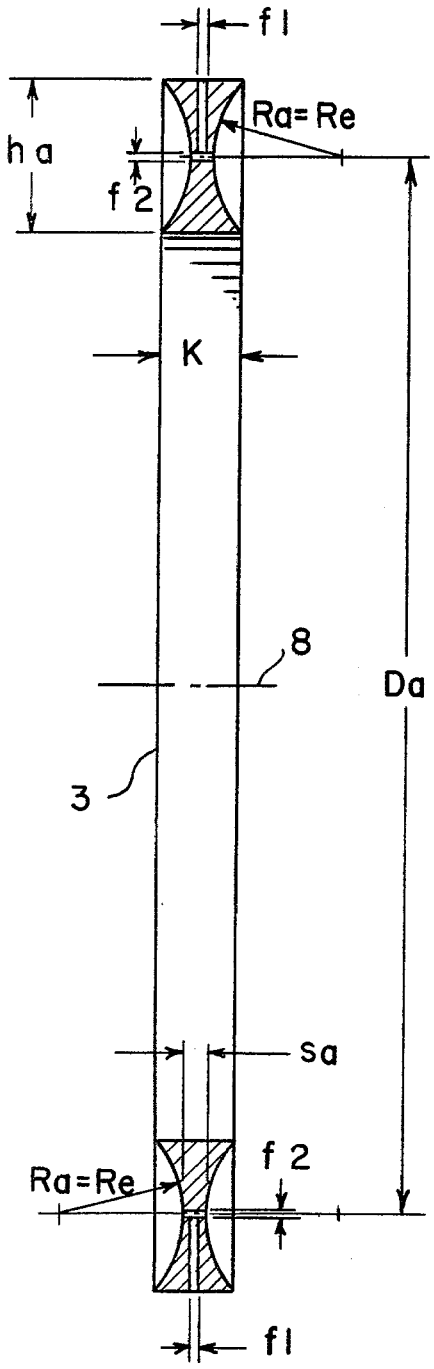
FIG. 3 is a cross-sectional view of a connecting ring.

As shown in FIG. 3, the connecting ring 3 may consist of the same basic metal as of the toric components 1. Its radius of curvature Ra corresponds to the outer radius of curvature Re of the toric components 1 to be joined. Its minimum wall thickness Sa is chosen as a function of the desired transverse resistance and preferably corresponds to the wall thickness of the toric components 1.

The dimensioning of the diameter Da across the axis 8 and of the height ha of the ring 3 is governed by the desired dimensions of the tank and of the toric component and by the accessibility for the welding operations. Typically, the diameter Da is equal to the distance between centers I of the toric components 1.

Two holes f1 are drilled diametrically opposite and communicate with two continuous holes f2. The holes f1 and f2 serve to discharge gases produced during welding. The holes f1 may be screw-threaded holes which are each subsequently sealed with a pressure-resistant screw plug (not illustrated).

Figure 4:
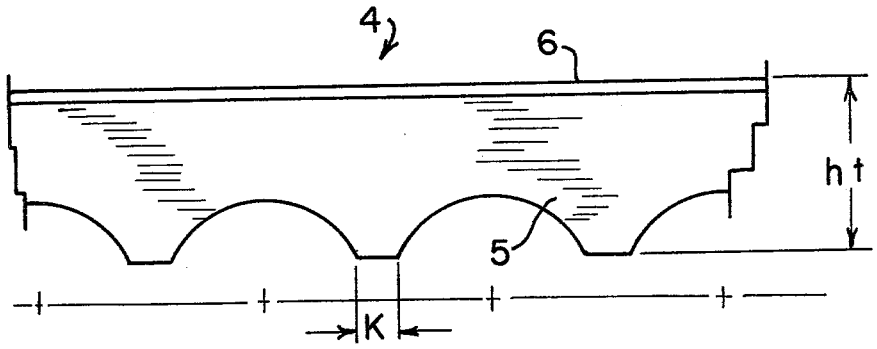
FIG. 4 shows a portion of a longitudinal connecting beam, with further embodiments shown in cross-section in FIGS. 4*a, b,* and *c;*
Figure 4A:
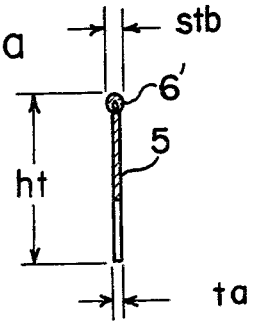
Figure 4B:
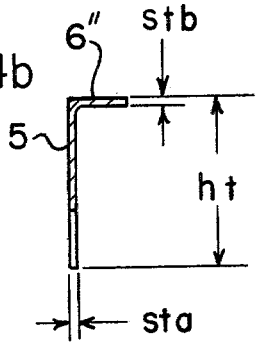
Figure 4C:
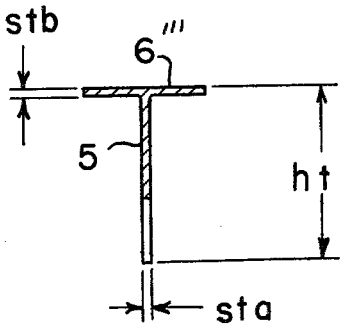

The longitudinal connecting beam 4, as shown in FIG. 4, consists either of the same basic metal of the toric components 1, or of a compatible metal for welding purposes. The beam exhibits a longitudinal profile as illustrated in FIG. 4. The beam 4 is composed of a web 5 and a bead 6, the bead being shown in varied configurations as 6', 6'' and 6''' in FIGS. 4*a,* 4*b* and 4*c,* respectively. The height ht of the beam, the wall thickness sta of the web 5 and the thickness stb of the bead 6 are governed by the transverse strength required of the hull or tank constructed.

Figure 5:
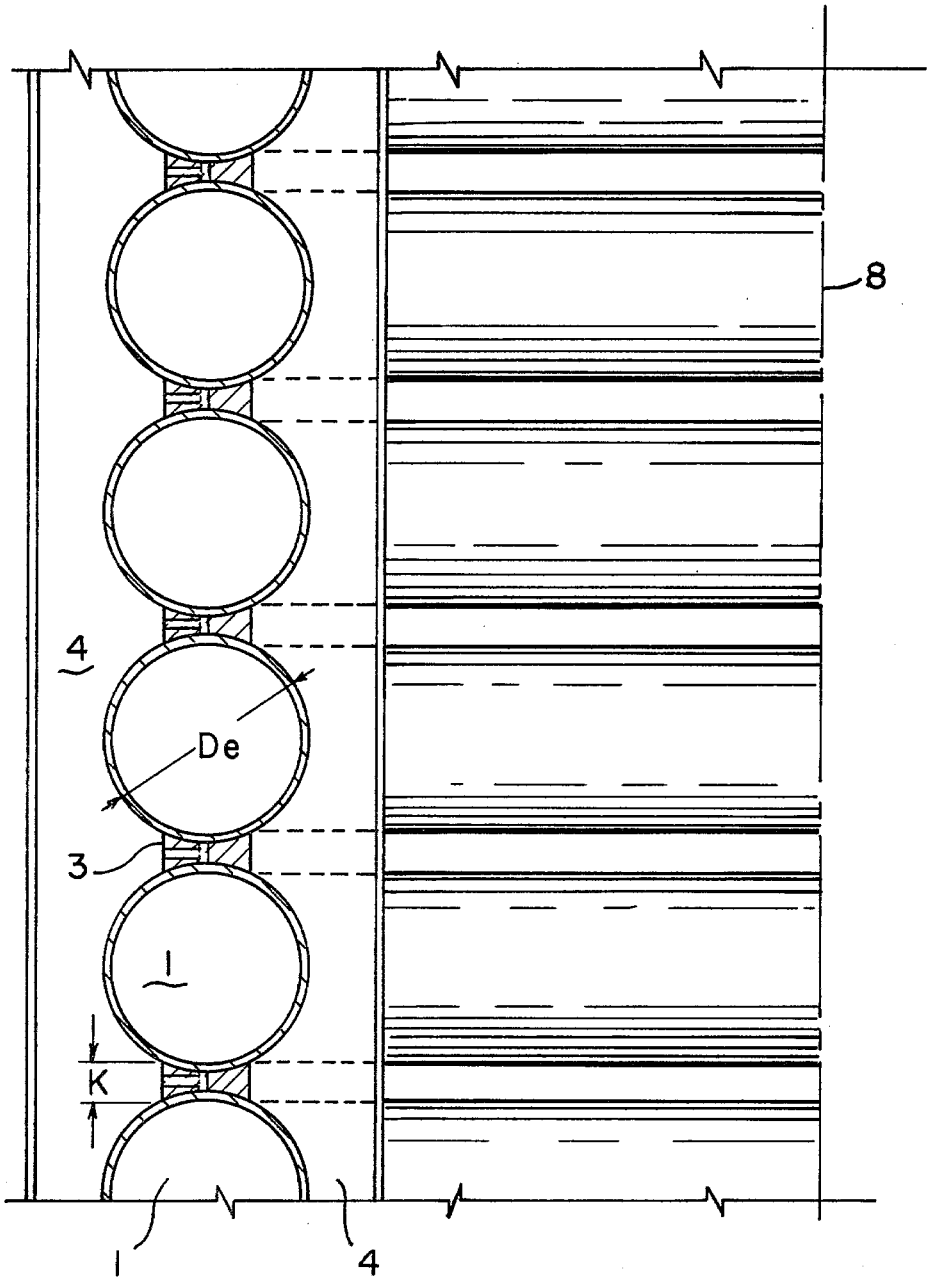
FIG. 5 illustrates in partial section a hull constructed according to the invention.

One embodiment of a hull is shown in partial section in FIG. 5. First, toric components 1 are positioned about axis 8 and are joined by welding or otherwise fusing to the connecting rings 3 to provide the transverse strength. The holes f1 of the connecting ring 3 should remain open during the welding operation.

Next, the connecting beams 4, which contribute the longitudinal strength, are brought into their connecting position and welded or otherwise fused to both the toric components and the connecting rings. The longitudinal connecting beams 4 are attached externally and/or internally, as required, and their mutual interval should be chosen so that the holes f1 of the connecting rings 3 are not blocked during the welding or fusing operation.

Finally, after the welding operations are completed, the structure must first be allowed to reach the ambient temperature. Then, the holes f1 are sealed with associated screw plugs.

Figure 6:
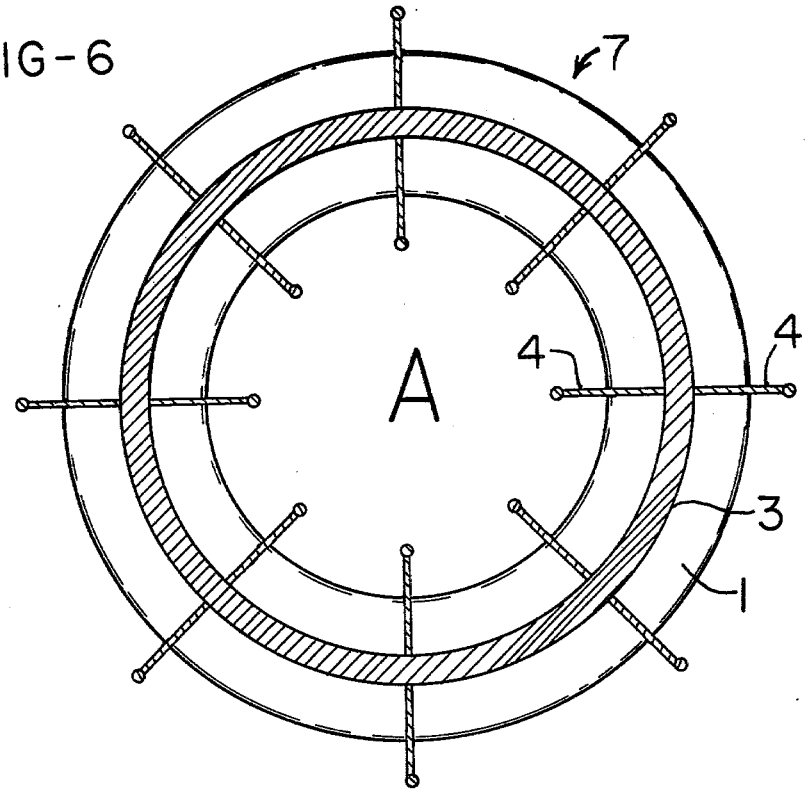
FIG. 6 illustrates in section a tank or hull constructed according to the invention, with an enlarged fragmentary longitudinal section being shown in FIG. 6*a.*
Figure 6A:
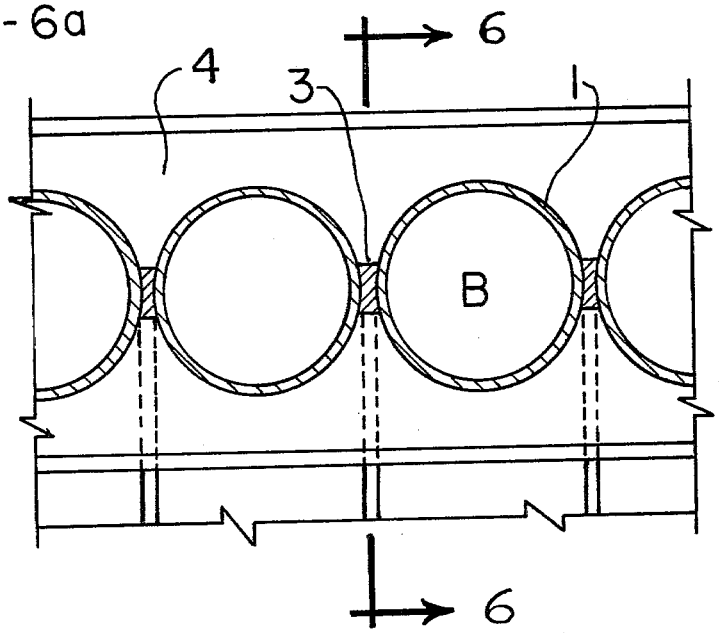

FIGS. 6 and 6*a* show, in cross-section and in fragmentary longitudinal section respectively, a tank or hull 7 constructed of the three basic elements, i.e., the toric component 1, the connecting ring 3 and the longitudinal connecting beam 4. The three basic elements are joined by welds, as described above.

A submarine hull or a storage tank can be assembled from a plurality of toric components as shown in the detailed drawing of FIGS. 5 and 6. The internal dimension of the storage tank or the useful interior space of the submarine hull is constituted by the volume A, whereas the auxiliary tanks for the storage of water ballast and/or other liquid cargo or for the storage of pressurized gas are constituted by the toric components 1 having an internal volume B. In addition, the toric components 1 simultaneously constitute the load-bearing hull.

I claim:

1. A structure for a hull for underwater use and which accommodates high external pressure when immersed to great depths, comprising a plurality of toric components positioned in a series about a common axis with each component being adjacent at least one other of the components, transversal connecting rings between each two adjacent toric components, said rings being shaped to engage the outer surface of each of the two toric components between which said ring is located and being fused to said two components, and inner and outer longitudinal connecting beams, said beams each having a profile to fit about the toric components and to fit against the rings between the components and being fused to said components and said rings.

* * * * *